US005334476A

United States Patent [19]

Yagi et al.

[11] Patent Number: 5,334,476

[45] Date of Patent: Aug. 2, 1994

[54] ELECTROPHOTOGRAPHIC PROCESS FOR SIMULTANEOUSLY TRANSFERRING AND FIXING AN IMAGE

[75] Inventors: Shigeru Yagi, Minami-ashigara; Taketoshi Higashi, Manami Ashigara; Yuzuru Fukuda, Manami Ashigara; Masato Ono, Manami Ashigara; Masaki Yokoi, Manami Ashigara; Masao Watanabe, Manami Ashigara, all of Japan

[73] Assignee: Fuji Xerox Co., Ltd., Tokyo, Japan

[21] Appl. No.: 865,475

[22] Filed: Apr. 9, 1992

[30] Foreign Application Priority Data

Apr. 15, 1991 [JP] Japan ..... 3-108325
Jan. 27, 1992 [JP] Japan ..... 4-033980

[51] Int. Cl.[5] ..... G03G 13/16
[52] U.S. Cl. ..... 430/126; 430/138
[58] Field of Search ..... 430/66, 98, 99, 126, 430/138

[56] References Cited

U.S. PATENT DOCUMENTS 4,885,220 12/1989 Kuhman et al. ..... 430/31
5,104,763 4/1992 Ong et al. ..... 430/138
5,108,860 4/1992 Birkle et al. ..... 430/66

FOREIGN PATENT DOCUMENTS 55-87156 7/1980 Japan .
57-179860 11/1982 Japan .
58-66948 4/1983 Japan .
59-148066 8/1984 Japan .
59-162562 9/1984 Japan .
64-43954 2/1989 Japan .

*Primary Examiner*—John Goodrow
*Attorney, Agent, or Firm*—Oliff & Berridge

[57] ABSTRACT

An electrophotographic process, which comprises the steps of: forming an electrostatic latent image on an amorphous silicon photoreceptor; developing the electrostatic latent image with a capsule toner; superimposing transfer paper on the capsule toner image thus formed; and simultaneously transferring and fixing the image on the paper by applying pressure.

12 Claims, 2 Drawing Sheets

ELECTROPHOTOGRAPHIC PROCESS FOR SIMULTANEOUSLY TRANSFERRING AND FIXING AN IMAGE

FIELD OF THE INVENTION

The present invention relates to an electrophotographic process in which transfer and fixation are simultaneously effected.

BACKGROUND OF THE INVENTION

In electrophotography, a process called the Carlson process has been heretofore widely employed which comprises the steps of charging, exposure, development, transfer, destatizing and cleaning on a photoreceptor. In this process, a toner image developed is transferred to paper, and it is then fixed in a heat roll process or a pressure fixing process to obtain a final image thereon.

In order to simplify such an image formation process, it has been proposed to effect transfer and fixation at the same time. As the system using an amorphous silicon photoreceptor, the following processes have been proposed: JP-A55-87156 (the term "JP-A" as used herein means an "unexamined published Japanese patent application") proposes a process in which a heat fixing roll is used to effect transfer and fixing of an image on a paper at the same time. JP-A-1-43954 proposes a process in which the transfer and fixation of an image are simultaneously effected by using an electrically conductive one-component toner.

However, the use of a heat fixing roll as proposed in JP-A-55-87156 is disadvantageous in that since the surface of the roll must be kept at a temperature as high as 180° C., the heat fixing roll cannot be always brought into contact with a photoreceptor drum, and the photoreceptor drum requires a cooling apparatus, thus complicating the mechanism. Furthermore, this system is not suitable for continuous use. The use of pressure as proposed in JP-A-1-43954 is also disadvantageous in that since a high pressure is required to obtain a practical image, the photoreceptor may be destroyed when a cardboard paper is used or wrinkling occurs on a paper.

In order to obtain a sufficient fixing performance in this simultaneous transfer and fixing process, it is necessary that the adhesion of the toner used to the paper be strong enough. In such a case, the adhesion of the toner to the photoreceptor as well is strong. This renders the photoreceptor easily adherable to the paper or filmed on the surface thereof, causing poor transfer that results in image defects.

SUMMARY OF THE INVENTION

An object of the present invention is to eliminate these difficulties of the prior art and thus provide an electrophotographic process which can provide an image with a sufficient fixing performance and a high reliability.

A further object of the present invention is to provide an electrophotographic process comprising a simultaneous transfer and fixing step which enables the use of an energy-saving and low cost image output apparatus that can operate at a reduced fixing pressure without causing any damage or toner adhesion to the photoreceptor.

These and other objects and effects of the present invention will become more apparent from the following detailed description and examples.

The present invention provides an electrophotographic process, which comprises the steps of: forming a electrostatic latent image on an amorphous silicon photoreceptor; developing the electrostatic latent image with a capsule toner; superimposing transfer paper on the capsule toner image thus formed; and simultaneously transferring and fixing the image on the paper by applying pressure.

BRIEF DESCRIPTION OF THE DRAWINGS

By way of example and to make the description more clear, reference is made to the accompanying drawings in which.

DETAILED DESCRIPTION OF THE INVENTION

Figure 1:
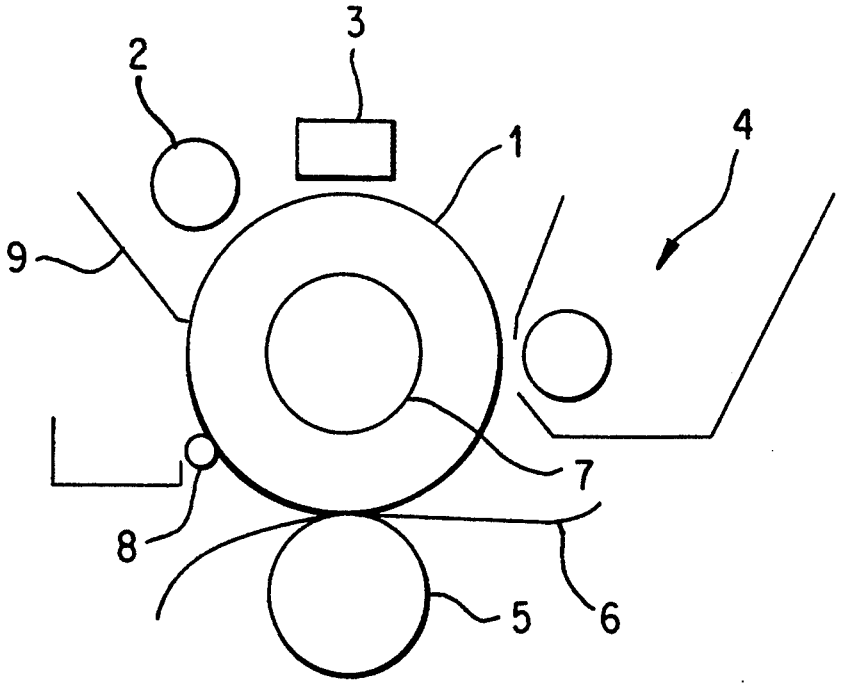
FIG. 1 is a schematic diagram of a copying apparatus embodying the present invention.

In the present invention, the capsule toner is preferably an electrically conductive magnetic one-component toner.

In the present invention, as the amorphous silicon photoreceptor, one having a surface layer that exhibits a contact angle of 60° or more with pure water is preferably used.

The present invention will be further described with reference to the drawings. One embodiment of the electrophotographic process of the present invention can be carried out as follows: The surface of photoreceptor 1 having an amorphous silicon light-sensitive layer is charged by charging apparatus 2. The charged surface of the photoreceptor 1 is then exposed to light through an original image obtained from an optical system or light from image input apparatus 3 such as a laser and an LED to form a electrostatic latent image thereon. The electrostatic latent image thus formed is then made visible and converted to a toner image with a capsule toner by developing apparatus 4. The toner image thus formed is then transferred to and fixed on paper 6 by means of pressure transfer roll 5. Inside photoreceptor 1 is provided heater 7 which is controlled to keep the surface temperature of photoreceptor 1 constant. The residual toner on the surface of photoreceptor 1 is removed by means of cleaner mechanism 8. A slight amount of electric charge which has remained on the surface of photoreceptor 1 is erased by destatizing light 9.

The amorphous silicon photoreceptor to be used in the present invention will be further described hereinafter. In the present invention, the amorphous silicon photoreceptor preferably has a surface layer.

Figure 2:
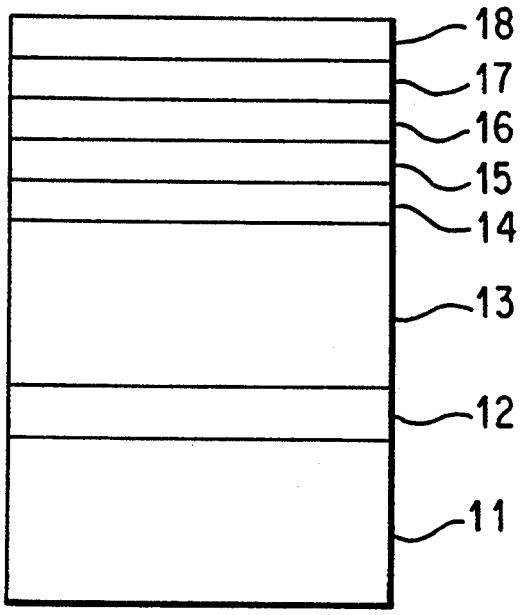
FIG. 2 shows a schematic section of an example of amorphous silicon photoreceptor used in the present invention.
Figure 3:
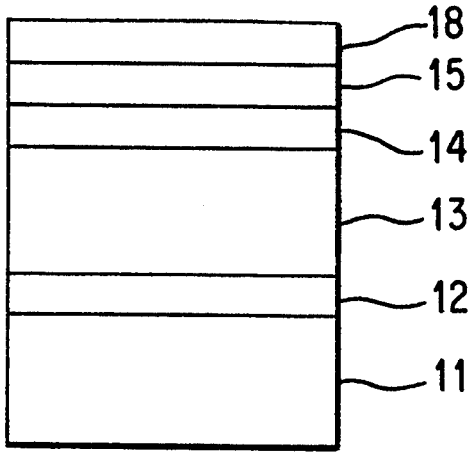
FIG. 3 shows a schematic section of another example of amorphous silicon photoreceptor used in the present invention.
Figure 4:
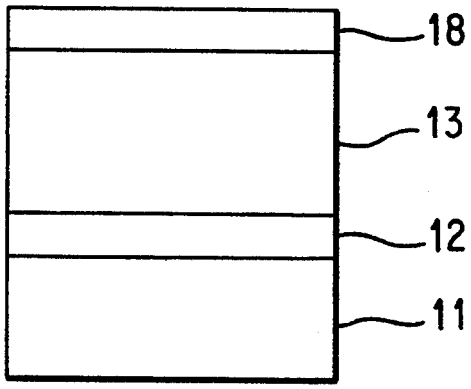
FIG. 4 shows a schematic section of further example of amorphous silicon photoreceptor used in the present invention.

FIGS. 2 to 4 show schematic sections of examples of the amorphous silicon photoreceptor used in the present invention. In the embodiment shown in FIG. 2, the photoreceptor comprises support 11 having consecutively thereon charge injection inhibiting layer 12, photoconductive layer 13, charge capturing layer 14, interlayers 15, 16 and 17, and surface layer 18.

In the embodiment shown in FIG. 3, interlayer 15 has a one-layer structure. In the embodiment shown in FIG. 4, the charge capturing layer and the interlayers are omitted.

As a material for support 11, aluminum, iron, stainless steel, alloy thereof or the like can be used. Glass, polycarbonate and acrylic resins which have been rendered electrically conductive can also be used. In general, the optimum thickness of the support according to transfer pressure can vary with its hardness. The thickness of the support is preferably in the range of 1 to 30 mm.

Each of the charge injection inhibiting layer 12 through the interlayer 17 is mainly composed of amorphous silicon. These layers can be formed by any suitable methods such as the glow discharge decomposition method, the sputtering method, the ion plating method and the vacuum deposition method. Taking the glow discharge decomposition method as an example, one embodiment of the preparation will be described below.

As a gas to be used as a starting material, a mixture of a main starting gas containing silicon atom and an auxiliary starting gas containing necessary additive elements can be used. The mixture may optionally contain a carrier gas such as hydrogen gas and an inert gas mixed therein. In the conditions for forming the layers, the frequency is 0 to 5 GHz, the inner pressure of the reactor is $10^{-5}$ to 10 Torr (0.001 to 1333 Pa), the discharge power is 10 to 3,000 W, and the support temperature is 30° to 300° C. The thickness of each layer can be properly determined by adjusting the discharge time. As the main starting gas containing silicon atom, silane is generally used, and preferably $SiH_4$ and/or $Si_2H_6$ is used.

Charge injection inhibiting layer 12 is composed of amorphous silicon and Group III or V elements added thereto. Examples of Group III element include B, Al, Ga and In with B being preferred. The concentration of Group III element in the layer is generally from $5\times10^{-3}$ to 5 atomic percent. Examples of Group V element include N, P, As and Sb. The concentration of Group V element in the layer is generally from $1\times10^{-3}$ to 0.1 atomic percent. Whether the additive elements to be used are of the III or V Group is determined by the polarity of charge on the photoreceptor. In the preparation of layer 12, diborane ($B_2H_6$) can generally be used as the starting gas containing Group III elements. As the starting gas containing Group V elements, phosphine ($PH_3$) can generally used. The charge injection inhibiting layer composed of amorphous silicon and Group III or V elements incorporated therein may further-comprise elements such as nitrogen, carbon, oxygen and halogen incorporated therein for the purpose, for example, of improving adhesiveness. The thickness of charge injection inhibiting layer 12 is generally from 0.2 to 5μm, and preferably from 0.5 to 2 μm.

Photoconductive layer 13 is composed of amorphous silicon and Group III elements incorporated therein. The thickness of photoconductive layer 13 is preferably in the range of 1 to 100 μm. As the starting gas containing Group III elements, diborane ($B_2H_6$) can generally be used. The amount of such a starting gas to be incorporated is determined by the polarity of charge on the photoreceptor and necessary spectral sensitivity and is generally in the range of 10 to 1,000 ppm. In addition to Group III elements, the photoconductive layer composed of amorphous silicon may further comprise elements such as nitrogen, carbon, oxygen and halogen incorporated therein for the purpose of improving chargeability, reducing dark decay and enhancing sensitivity. The photoconductive layer may be composed of two layers, i.e., a charge generating layer and a charge transporting layer.

Examples of the composition of the photoconductive layer include a-Si:H, a-Si:F,H, a-$Si_{1-x}C_x$:H ($0<x<0.3$), a-$SiN_x$:H ($0<x<0.2$), a-$SiO_x$:H ($0<x<0.1$) and a-$Si_{1-x}Ge_x$:H.

In the case where the photoconductive layer is composed of a charge generating layer and a charge transporting layer, the charge generating layer may have the basically same composition as the above photoconductive layer, and the charge transporting layer also may have the basically same composition as the photoconductive layer.

Preferred examples of the charge generating layer include those mainly composed of amorphous silicon containing hydrogen and/or halogen, and one or both of Ge and Sn may be added thereto for the sensitization in the low-frequency region. Examples of the source of Ge include $GeH_4$, $Ge_2H_6$, $Ge_3Hs$, $Ge_4H_{10}$, $GesH_{12}$, $GeF_4$ and $GeCl_4$. Examples of the source of Sn include $SnCl_2$ and $SnCl_4$. Group III elements and Group V elements may be added to the charge generating layer to improve the efficiency of injection of the carrier. Examples of the source of Group III and Group V elements include $B_2H_6$, $B_4H_{10}$, $BF_3$, $BC_3$, $PH_3$, $PCl_4$, $PF_3$ and $PCl_3$.

In the case where the charge generating layer is produced by the plasma CVD method in which silane gas or the like is decomposed by glow discharge, the frequency of alternating current discharge is generally from 0.1 to 30 MMz, preferably 0.1 to 20 MMz, the pressume upon discharge is generally from 0.1 to 5 Torr (1.33 to 66.7 $N/m^2$), the temperature of the substrate is generally from 100° to 400° C., and the rate of formation of the layer is generally from 1 to 5 μm/hour.

The thickness of the charge generating layer is not particularly limited and is generally from 0.5 to 10 μm, and preferably from 1 to 5 μm.

In the charge transporting layer, at least one of carbon, oxygen and nitrogen may be added to an amorphous silicon layer to increase the dark resistance, the photosensitivity and the charging ability of the charge transporting layer. The "charging ability" referred to herein means the capacity of charging per unit thickness or the charging potential per unit thickness. The charge transporting layer may further contain other elements. For example, impurities such as Group I II and Group V elements (e.g., B and P) may be doped to control the dark resistance and the charging polarity of the charge transporting layer. Examples of the source of Group III and Group V elements include $B_2H_6$, $B_4H_{10}$, $BF_3$, $BCl_3$, $PH_3$, $P_2H_4$, $PF_3$ and $PCl_3$. In the case where the charge transporting layer is produced by the plasma CVD method, the frequency of alternating current discharge is generally from 0.1 to 30 MHz, the pressume upon discharge is generally 0.1 to 5 Torr (1.33 to 66.7 $N/m^2$), the temperature of the substrate is generally from 100° to 400° C., and the rate of formation of the layer is generally from 1 to 10 μm/hour.

The thickness of the charge transporting layer is generally from 5 to 50 μm, and preferably from 10 to 30 μm. Examples of Group III element include B, A, Ga and In with B being preferred.

Charge capturing layer 14 is composed of amorphous silicon and Group III or V elements incorporated therein. The concentration of Group III element in the layer is generally from $5\times10^{-3}$ to 5 atomic percent. Examples of Group V element include N, P, As and Sb. The concentration of Group V element in the layer is generally from $1\times10^{-3}$ to 0.1 atomic percent. The thickness of charge capturing layer 14 is preferably in the range of 0 01 to 10 μm Whether the additive elements to be used are of Group III or V is determined by the polarity of charge on the photoreceptor. As the starting gas containing Group III elements, diborane can generally used. As the starting gas containing Group V elements, phosphine can generally be used. In addition to Group III or V elements, the charge capturing layer composed of amorphous silicon may further comprise other elements for various purposes.

In the present invention, the electrophotographic photoreceptor may be free of an interlayer as shown in FIG. 4. If any interlayer is present, it may have a one-layer structure as shown in FIG. 3 or may be composed of a plurality of layers as shown in FIG. 2.

First, second and third interlayers 15, 16 and 17 in FIG. 2 are composed of amorphous silicon and carbon, oxygen or nitrogen atoms incorporated therein. In the formation of these interlayers, as the starting gas containing nitrogen atom, there can be used any element or compound comprising nitrogen atom as a constituent element that can be used in a gas phase. Examples of such an element or compound include $N_2$ gas, and hydrogenated nitrogen compound gas such as $NH_3$, $N_2H_4$ and $NH_3$. The starting gases containing nitrogen atom to be incorporated in these interlayers may be the same or different. These surface layers may further contain other elements for various purposes.

Examples of the starting gas containing carbon atom which can be used in the present invention include hydrocarbon such as methane, ethane, propane and acetylene, and halogenated hydrocarbon such as $CF_4$ and $C_2F_6$. Examples of the starting gas containing oxygen atom which can be used in the present invention include $O_2$, $N_2O$, CO, and $CO_2$.

The concentrations of carbon, oxygen and nitrogen atoms in first interlayer 15 each is preferably in the range of 0.1 to 1.0 as calculated in reigns of the ratio of the number of atoms to that of silicon atoms. The thickness of first interlayer 15 is preferably in the range of 0.01 to 0.1 μm.

The concentrations of carbon, oxygen and nitrogen atoms in second interlayer 16 each is preferably higher than that of first interlayer 15 and in the range of 0.1 to 1.0 as calculated in terms of the ratio of the number of atoms to that of silicon atoms . The thickness of second interlayer 16 is preferably in the range of 0.05 to 1 μm.

The concentrations of carbon, oxygen and nitrogen atoms in third interlayer 17 each is preferably higher than that of second interlayer 16 and in the range of 0.5 to 1.3 as calculated in terms of the ratio of the number of atoms to that of silicon atoms. The thickness of third interlayer 17 is preferably in the range of 0.01 to 0.1 μm.

In the amorphous silicon photoreceptor of the present invention, as the material constituting surface layer 18 to be provided on the photoconductive layer or the interlayer, there can be used $SiO_x$, $SiN_x$, $SiC_x$ a-C, $AlO_x$ or the like as film-foxing material for the plasma CVD method, the vacuum deposition method or the ion plating method or a hardening resin such as silicone hard coating agents, thermosetting organic high pollers, epoxy resins and urethane resins can be used as a coating film for the solvent cast method The surface layer is effective for the inhibition of flaws occurring on the surface of the amorphous silicon photoreceptor upon pressure fixing and for the enhancement of transfer efficiency.

In the present invention, the surface layer preferably exhibits a contact angle of 60° or more, more preferably 80° or more, with pure water. Among the above materials, as surface layer-forming materials for plasma CVD method, there can be preferably used a-C:H, a-C:F, a-$C_xSi_{(1-x)}$:H, and a-$C_xSi_{(1-x)}$:F (in which $x>0.5$) formed from hydrogenated and/or halogenated hydrocarbon. Alternatively, the surface layer may be formed from a compound having many alkyl groups at the terminals of a silicon hard coating mainly composed of siloxane bonds.

In the present invention, the surface layer may also be a layer comprising finely divided grains of electrically conductive metal oxide dispersed in a binder resin. The finely divided grains of electrically conductive metal oxide preferably have an average diameter of 0.8 μm or less, more preferably 0.05 to 0.3 μm. Examples of such finely divided grains of electrically conductive metal oxide include finely divided grains of zinc oxide, titanium oxide, tin oxide, antimony oxide, indium oxide, bismuth oxide, tin-doped indium oxide, antimony-doped tin oxide, and zirconium oxide. These finely divided metal oxide grains can be used singly or in combination. If two or more kinds of these finely divided metal grains are used, they may be used in the form of solid solution or fused body.

As the high polymer to be used as a binder resin there can be used an electrically active high polymer such as polyvinyl carbazole or electrically inert high polymer. Examples of such a high polymer which can be used in the present invention include polyvinyl carbazole, acrylic resins, polycarbonate resins, polyester resins, vinyl chloride resins, fluorine resins, polyurethane resins, epoxy resins, unsaturated polyester resins, polyamide resins, and polyimide resins. Particularly preferred among these resins are thermosetting resins in the light of mechanical strength and adhesiveness.

As inorganic high molecular weight material to be used as a binder resin, there can be used silicone resins and inorganic high molecular weight compound made of organic metal compounds. If a silicone resin is used, it may comprise the above mentioned finely divided grains of electrically conductive metal oxide dispersed therein. The preparation of an inorganic high molecular weight compound from an organic metal compound can be accomplished by the sol-gel method. That is, an alkoxide compound, such as $Si(OCH_3)_4$, $Si(OC_2H_5)_4$, $Si(OC_3H_7)_4$, $Si(OC_4H_9)_4$, $Al(OCH_3)_3$, $Al(OCH_2H_5)_3$, $Al(OC_4H_9)_3$, $Ti()C_3H_7)_4$, $ZR(OC_3H_7)_4$, $Y(OC_3H_7)_3$, $Y(OC_4H_9)$, $Fe(OC_2H_5)_3$, $Fe(OC_3H_7)_3$, $Fe(OC_4H_9)_3$, $Nb(OCH_3)_5$, $Nb(OC_2H_5)_5$, $Nb(OC_3H_7)_5$, $Ta(OC_3H_7)_3$, $Ta(OC_4H_9)_4$, $V(OC_2H_5)_3$ and $V(PC_4Hg)_3$, or organic metal complex, such as iron-tris(acetylacetonato), cobalt-bis(acetylacetonato), nickel-bis(acetylacetonato) and copper-bis(acetylacetonato), is dissolved and hydrolyzed in an alcohol with stirring. The above mentioned finely divided grains of electrically conductive metal oxide are then dispersed in the sol produced by the reaction. The resulting dispersion is coated by the spray method, the dipping method or the like, and then heated and dried at a temperature of 50° to 300° C. for 1 to 24 hours.

The thickness of the surface layer is preferably in the range of 20 μm or less, and more preferably 0.1 μm to 10 μm.

The capsule toner to be used in the present invention comprises a core material and a shell material.

As the core material, there can be preferably used a material composed of a binder resin, a high boiling point organic solvent for dissolving the binder resin therein, and a coloring material, or a material composed of a soft solid substance and a coloring material. If necessary, an additive such as silicone oil can be added to the core material for the purpose of improving fixability. Furthermore, a high boiling point solvent which does not dissolve the binder resin therein may be added to a high boiling solvent which dissolves the binder resin therein.

As the binder resin, known fixing resins can be used. Specific examples of such known fixing resins include acrylic ester polymers such as methyl polyacrylate, ethyl polyacrylate, butyl polyacrylate, 2-ethylhexyl polyacrylate and lauryl polyacrylate, methacrylic ester polymer such as methyl polymethacrylate, butyl polymethacrylate, hexyl polyrmethacrylate, 2-ethylhexyl polymethacylate and lauryl polymethacrylate; ethylene polymers and copolymers thereof such as copolymers of styrene monomers and acrylic esters or methacrylic esters, polyvinyl chloride, polyvinyl propionate, polyvinyl acetate, polyethylene and polypropylene; styrene copolymers such as styrene-butadiene copolymers and styrene-maleic acid copolymers; polyvinyl ether; polyvinyl ketone; polyester; polyamide; polyurethane; rubbers; epoxy resins; polyvinyl butyral; rosin; modified rosin; terpene resins; and phenolic resins. These resins may be used singly or in admixture. Alternatively, these resins may be charged in the form of monomer, and then polymerized after the completion of capsulation to form a binder resin.

As the high boiling solvent for dissolving the binder resin therein, an oily solvent having a boiling point of 140° C. or higher, preferably 160 ° C. or higher, can be used. Specific examples of such an oily solvent include phthalic esters (e.g., diethyl phthalate, dibutyl phthalate), aliphatic dicarboxylic esters (e.g., malonic diethyl, oxalic dimethyl), phosphoric esters (e.g., tricresyl phosphate, trixylyl phosphate), citric esters (e.g., o-acetyltriethyl citrate), benzoic esters (e.g., butyl benzoate, hexyl benzoate), aliphatic esters (e.g., hexadecyl myristate, dioctyl adipate), alkyl naphthalenes (e.g., methyl naphthalene, dimethyl naphthalene, monoisopropyl naphthalene, diisopropyl naphthalene), alkyl diphenyl ethers (e.g., o-, m-, or p-methyl diphenyl ether), higher aliphatic or aromatic sulfonic amide compounds (e.g., N,N-dimethyllauroamide, N-butylbenzenesulfonamide), trimellitic esters (e.g., trioctyl trimellitate), diarylalkanes (e.g., diarylmethane such as dimethylphenyl phenyl methane, diarylethane such as 1-phenyl-l-methylphenylethane, 1-dimethylphenyl-1-phenylethane and 1-ethylphenyl-l-phenylethane), and chlorinated paraffins.

Examples of coloring materials which can be used in the present invention include inorganic pigments such as carbon black, red iron oxide, Prussian blue and titanium oxide, azo pigments (such as fast yellow, disazo yellow, pyrazolone red, chelate red, brilliant carmine and para brown), phthalocyanines (such as copper phthalocyanine and metal-free phthalocyanine), and condensed polycyclic pigments (such as flavanthrone yellow, dibromoanthrone orange, perylene red, quinacridone red and dioxane violet). Furthermore, dispersed dyes, oil-soluble dyes, etc. may be used.

The capsule toner used in the present invention may be a one-component toner composed of the toner only, and alternatively may be a two-component toner composed of the toner and carrier particles which impart electroconductivity to the toner.

Examples of the carrier particles used in the case of two-component toner include magnetic or non-magnetic particles such as glass beads, particles of various polymers, iron powder, nickel particles, ferrite particles, magnetite particles and magnetic powder-dispersed particles composed of a binder resin and magnetic fine powder such as magnetite dispersed therein. The whole or part of the surface of the magnetic or non-magnetic powder may be coated with a styrene resin, acrylate resin, methacrylate resin, fluorine resin or silicone resin, in order to control the surface energy and to impart charging ability to the toner. The diameter of the carrier particle is generally from 5 to 100 μm, and preferably from 20 to 80 μm. The thickness of the coated layer is generally from 0.001 to 2 μm, and preferably from 0.01 to 0.5 μm. Carrier particles used in combination with the capsule toner preferably have a relatively low specific gravity.

In the present invention, when the capsule toner is an electrically conductive magnetic one-component toner, it can be obtained by replacing the entire or part of a black coloring material with magnetic powder. As the magnetic powder, magnetite and ferrite, as well as metals such as cobalt, iron, nickel, and alloys thereof are suitable. The surface of the magnetic powder may be treated with a coupling agent (such as a silane coupling agent and a titanate coupling agent) and an oil-soluble surface active agent. The surface of the magnetic powder may be coated with an acrylic resin, styrene resin or epoxy resin. The capsule toner may also be imparted with electro-conductivity by externally adding titanium oxide, carbon black and the like to the capsule toner.

As the soft solid substance, any kind of substance that exhibits flexibility at room temperature and fixability can be used. Polishers having Tg between −60° and 5° C. may be preferably used. Specific examples thereof include homopolymers of acrylate or methacrylate such as methyl methacrylate, copolymers of acrylate or methacrylate with styrene monomers, homopolymers and copolymers of ethylenic monomers (such as polyvinyl acetate), styrene copolymers (such as styrene-butadiene copolymers, styrene-isoprene copolymers and styrene-maleic acid copolymer), polyvinyl ethyer polyvinyl ketone, polyester, polyamide, polyurethane, rubber, epoxy resins, polyvinyl butyral rosin, modified rosin-terpene resins and phenol resins. These polymers and resins may be used singly or in combination of two or more thereof. These polymers and resins may be used in such a manner that the monomer is charged in the system for the formation of capsule toner and is polymerized after completion of capsulation.

The capsule toner may contain additives such as silicon oxide, aluminum oxide, titanium oxide and carbon black incorporated therein to obtain fluidity or chargeability. In order to add these additives to the capsule toner, they may be mixed with the capsule toner which has been dried in a mixer such as a V blender and a Henschel mixer so that they are attached to the surface of the toner. Alternatively, these additives may be dispersed in water or an aqueous liquid such as mixture of water and alcohol, added to a slurry of the capsule toner, and then dried so that they are attached to the surface of the toner. The amount of the additives is generally from 0.01 to 5% by weight, preferably from 0.1 to 5% by weight, based on the total amount of the toner.

The shell material preferably comprises polyurea resins, polyuethane resins, polyamide resins, polyester resins, epoxy resins, epoxyurea resins, or epoxyurethane resins. The more preferred among these include the single use of a polyurea resin or a polyurethane resin, the combined use of a polyptea resin and a polyurethane resin, the single use of an epoxyurea resin or an epoxyurethane resin, and the combined use of an epoxyurea resin and an epoxyurethane resin.

The capsulation method is not specifically limited. Interfacial polymerization is preferably used in light of the resulting completeness of covering and mechanical strength of shell. In the preparation of capsule toner by interfacial polymerization, any known method can be used as disclosed, e.g., in JP-A-57-179860, JP-A-58-66948, JP-A-59-148066 and JP-A-59-162562.

In order to incorporate the above mentioned polymer in the capsule as one component of the core material, these polymers may be charged into a system together with other core-forming components, low boiling solvent and shell-forming components to cause interfacial polymerization which forms shell. At the same time with or after the formation of shell, the low boiling solvent may be driven out from the system to form core.

The particle diameter of the capsule toner used in the present invention is preferably in the range of 5 to 25 μm as calculated in terms of volume-average particle diameter.

In the electrophotographic process of the present invention, transferring and fixing of the image can be simultaneously carried out in the following manner: A pressure roll is directly in contact with the surface of the photoreceptor with pressure to form a nip part through which transfer paper passes. By passing transfer paper through the nip part, the toner adhered imagewise on the surface of the photoreceptor is transferred to the paper, and simultaneously the toner particles adhered on the paper are collapsed by the pressure. At this time, the binder resin contained in the toner particle penetrates into the fibrous structure of the transfer paper so that simultaneous transferring and fixing are achieved.

The simultaneous transferring and fixing process using a drum of dielectric materials but not using photoreceptor is disclosed in U.S. patent application Ser. No. 07/644,974 filed on Jan. 23, 1991.

In accordance with the present invention when, a material having an excellent fixability is used as the core material, fixing at a pressure as low as about 4/5 to ½ of the ordinary fixing pressure can be conducted. The fixing pressure (nip pressure of the photoreceptor and a pressure roll) is generally from 100 to 400 Kg/cm$^2$, and preferably from 150 to 350 Kg/cm$^2$. The fixing speed (process speed of electrophotographic process) is generally from 25 to 1,000 mm/sec, and preferably from 100 to 800 mm/sec.

In the present invention, the photoreceptor may be heated to a temperature of 30° to 80° C. to improve fixability and reduce the fixing pressure. If the fixing temperature is higher than 80° C., the dark resistance of the amorphous silicon photoreceptor tends to be reduced, making it difficult to obtain the static potential necessary for development. In the copying apparatus shown in FIG. 1, heating is effected inside the photoreceptor. Heating may also be effected outside the photoreceptor.

As heating means, there can be used a lamp heater (quartz lamp) or a plane heater comprising a nichrome wire embedded in heat-resistant rubber such as silicone rubber. In addition, a hot-air blowing heater, a heater utilizing radiation such as infrared rays, a heater utilizing the heat emitted by the fixing portion, etc. can be used. Means for conducting electric current to these heating means is not particularly limited. In particular, when the heating means is provided inside the support of the photoreceptor, which rotates, a means which conducts electric current to the heating means through a slip ring is preferably used.

The present invention will be further described in the following examples, but the present invention should not be construed as being limited thereto.

EXAMPLE 1

An image was formed with a capsule toner with a particle diameter of 15 μm composed of a core material made of a lauryl methacrylate (LMA) polymer (weight average molecular weight: $10\times10^4$) and a magnetic powder covered by a polyurea resin, by means of a copying apparatus as shown in FIG. 1, in which an amorphous silicon photoreceptor provided with three interlayers each made of $SiN_x$ and each having a thickness of 0.5 μm was mounted.

The above mentioned capsule toner was prepared as follows:

| | |
|---|---|
| (Core material) | |
| Lauryl methacrylate polymer (produced by Sanyo Kasei K.K.) | 40 parts |
| Magnetic powder (EPT-100, produced by Toda Kogyo K.K.) | 60 parts |
| (Shell material) | |
| Polyurea resin (product of interfacial polymerization of polymethylene polyphenyl isocyanate and diethylene triamine) | |

A polymethylene polyphenyl isocyanate (produced by Dow Chemical) was added to a part of the above mentioned core material. The material was then emulsified and granulated. An aqueous solution of diethylene triamine was added to the material to cause interfacial polymerization to prepare capsule grains which were then dried by a spray dryer.

To the capsule grains thus obtained were added 0.5 wt % of zinc stearate to prepare a capsule toner.

The amorphous silicon photoreceptor was prepared as follows:

The reaction vessel was thoroughly evacuated. Into the reaction vessel was introduced a mixture of silane gas, hydrogen gas and diborane gas, and the mixture was then decomposed by glow discharge to form a 4-μm thick charge injection inhibiting layer on a cylindrical Al-Mg alloy substrate having a thickness of about 20 nun. The producing conditions were as follows:

Flow rate of 100% silane gas: 180 cm3/min
Flow rate of 100% hydrogen gas: 90 cm$^3$/min
Flow rate of 200 ppm hydrogen-diluted diborane gas: 90 cm$^3$/min.
Inner pressure of reaction vessel: 1.0 Torr
Discharge power: 200 W
Discharge time: 60 min
Discharge frequency: 13.56 MHz Support temperature: 250° C.

In the following description, the discharge frequency and the support temperature were the same as the above mentioned values for other various layers.

After the formation of the charge injection inhibiting layer, the reaction vessel was thoroughly evacuated. Into the reaction vessel was introduced a mixture of silane gas, hydrogen gas and diborane gas, and the mixture was then decomposed by glow discharge to form a 15-μm thick photoconductive layer on the charge injection inhibiting layer. The producing conditions were as follows:

Flow rate of 100% silane gas: 180 $cm^3$/min
Flow rate of 100% hydrogen gas: 162 $cm^3$/min
Flow rate of 20 ppm hydrogen-diluted diborane gas: 18 $cm^3$/min.
Inner pressure of reaction vessel: 1.0 Torr
Discharge power: 200 W
Discharge time: 210 min After the formation of the photoconductive layer, the reaction vessel was thoroughly evacuated. Into the reaction vessel was introduced a mixture of silane gas, hydrogen gas and diborane gas, and the mixture was then decomposed by glow discharge to form a 0.9-μm thick charge capturing layer on the photoconductive layer. The producing conditions were as follows:

Flow rate of 100% silane gas: 180 $cm^3$/min
Flow rate of 100% hydrogen gas: 90 $cm^3$/min
Flow rate of 20 ppm hydrogen-diluted diborane gas: 90 cm3/min.
Inner pressure of reaction vessel: 1.0 Torr
Discharge power: 200 W
Discharge time: 12 min After the formation of the charge capturing layer, the reaction vessel was thoroughly evacuated. Into the reaction vessel was introduced a mixture of silane gas, hydrogen gas and ammonia gas, and the mixture was then decomposed by glow discharge to form an about 0.15-μm thick first interlayer on the charge capturing layer. The producing conditions were as follows:

Flow rate of 100% silane gas: 26 $cm^3$/min
Flow rate of 100% hydrogen gas: 180 $cm^3$/min
Flow rate of 100% ammonia gas: 30 $cm^3$/min
Inner pressure of reaction vessel: 0.5 Torr
Discharge power: 50 W
Discharge time: 30 min After the formation of the first interlayer, the reaction vessel was thoroughly evacuated. Into the reaction vessel was introduced a mixture of silane gas, hydrogen gas, and ammonia gas, and the mixture was then decomposed by glow discharge to form an about 0.25-μm thick second interlayer on the first interlayer. The producing conditions were as follows:

Flow rate of 100% silane gas: 24 $cm^3$/min
Flow rate of 100% hydrogen gas: 180 $cm^3$/min
Flow rate of 100% ammonia gas: 36 $cm^3$/min
Inner pressure of reaction vessel: 0.5 Torr
Discharge power: 50 W
Discharge time: 40 min After the formation of the second interlayer, the reaction vessel was thoroughly evacuated. Into the reaction vessel was introduced a mixture of silane gas, hydrogen gas and ammonia gas which was then decomposed by glow discharge to form an about 0.1-μm thick third interlayer on the second interlayer. The producing conditions were as follows:

Flow rate of 100% silane gas: 15 $cm^3$/min
Flow rate of 100% hydrogen gas: 180 $cm^3$/min
Flow rate of 100% ammonia gas: 43 $cm^3$/min
Inner pressure of reaction vessel: 0.5 Torr
Discharge power: 50 W
Discharge time: 20 min On the third interlayer was then formed a surface layer made of an inorganic high molecular weight compound containing finely divided grains of electrically conductive metal oxide having an average grain diameter of 0.3 μm or less dispersed therein. The producing conditions were as follows:

| | |
|---|---|
| X-41-9710 (silicone for protective coating produced by Shin-etsu Chemical Industry Co., Ltd.) | 50 parts by weight |
| Electrically conductive powder of tin oxide containing 15% of antimony oxide | 9 parts by weight |

These components were then subjected to dispersion in admixture at a temperature of 10° C. for 50 hours. The dispersion was coated on the third interlayer by a spray coating method, and then dried at a temperature of 180° C. for 1 hour to form a surface layer having a thickness of 1 μm.

In the formation of an image, charging, exposure and development were effected by ordinary methods. The surface of the photoreceptor drum was kept at a temperature of about 30° C. by a photoreceptor drum heating apparatus to cause transfer and fixing. Specifically, a transfer paper was inserted into the gap between a transfer roll made of a polyvinyl acetal and the photoreceptor drum while the transfer roll was pressed against the photoreceptor drum at a pressure of 200 kg/$cm^2$ and a processing speed of 200 mm/sec to cause simultaneous transfer and fixing. As a result, an image was produced having the same fixing quality as obtained by conventional heat fixing.

EXAMPLE 2

A copying procedure was effected using the same photoreceptor and copying machine as used in Example 1 except that the capsule toner was replaced by a capsule toner which had been rendered electrically conductive by adding 2 wt % of carbon black (Balkan XC72, produced by Cabot). In this case, the potential necessary for development was 100 V. The image thus obtained resulted from sufficient transfer and fixing by pressure and exhibited the same fixing quality as obtained by conventional heat fixing.

EXAMPLE 3

A copying procedure was effected using the same photoreceptor and copying machine as used in Example 1 except that as capsule toner there was used one prepared as follows:

| (Capsule toner) | |
|---|---|
| Carbon black | 1 g |
| Tricresyl phosphate | 13 cc |
| Isocyanate (Desmodure L produced by Bayer) | 1 g |

A solution of the above mentioned composition was added dropwise to a solution of 7 g of polyvinyl alcohol in 100 cc of water to obtain an emulsion of finely divided drops which was then maintained at room temperature for about 2 hours and then at an elevated temperature to form microcapsules. The resulting microcapsule dispersion was subjected to centrifugal separation to separate the microcapsules which were then dried to obtain a capsule toner.

5 parts of the capsule toner and 95 parts of iron powder were mixed by a shaker to obtain a developer.

Transfer and fixing were effected at various temperatures at a pressure of 250 kg/cm$^2$. An examination of the fixability of the image thus obtained by a paper folding test gave the following results:

TABLE 1

| 20° C. | 30° C. | 40° C. | 50° C. | 60° C. |
|---|---|---|---|---|
| Fair | Good | Excellent | Excellent | Excellent |

(Note)
Fair: White lines occur
Good: Slight toner peel observed at fold
Excellent: No toner peel observed at fold An examination of the relationship between the image density and the photoreceptor drum temperature gave the following results:

TABLE 2

| (density) | | | | | |
|---|---|---|---|---|---|
| 20° C. | 30° C. | 40° C. | 50° C. | 80° C. | 90° C. |
| 1.5 | 1.5 | 1.5 | 1.3 | 0.9 | 0.5 |

EXAMPLE 4

A charge injection inhibiting layer, a photoconductive layer, and a charge capturing layer were formed in the same manner as in Example 1.

After the formation of the charge capturing layer, the reaction vessel was thoroughly evacuated. Into the reaction vessel was introduced a mixture of silane gas, hydrogen gas, and ammonia gas, and the mixture was then decomposed by glow discharge to form an about 0.15-μm surface layer on the charge capturing layer. The surface layer thus formed exhibited a contact angle of 55° with pure water. The producing conditions of the surface layer were as follows:

Flow rate of 100% silane gas: 26 cm$^3$/min
Flow rate of 100% hydrogen gas: 180 cm$^3$/min
Flow rate of 100% ammonia gas: 30 cm$^3$/min
Inner pressure of reaction vessel: 0.5 Torr
Discharge power: 50 W
Discharge time: 30 min In the formation of an image, charging, exposure and development were effected by ordinary methods. Transfer and fixing were then effected. Specifically, a transfer paper was inserted into the gap between a transfer roll made of a polyvinyl acetal and the photoreceptor drum while the transfer roll was pressed against the photoreceptor drum at a pressure of 200 kg/cm$^2$ to cause transfer and fixing at the same time. As a result, an image was produced having the same fixing quality as obtained by conventional heat fixing.

A slight amount of the toner remained on the surface of the photoreceptor after transfer. However, the toner could be removed by a cleaning process.

EXAMPLE 5

A charge injection inhibiting layer, a photoconductive layer, and a charge capturing layer were prepared in the same manner as in Example 1.

After the formation of the charge capturing layer, the reaction vessel was thoroughly evacuated. Into the reaction vessel was introduced a mixture of silane gas, hydrogen gas and ammonia gas, and the mixture was then decomposed by glow discharge to form an about 0.15-μm thick interlayer on the charge capturing layer. The producing conditions were as follows:

Flow rate of 100% silane gas: 26 cm$^3$/min
Flow rate of 100% hydrogen gas: 180 cm$^3$/min
Flow rate of 100% ammonia gas: 30 cm$^3$/min
Inner pressure of reaction vessel: 0.5 Torr
Discharge power: 50 W
Discharge time: 30 min After the formation of the interlayer, the reaction vessel was thoroughly evacuated. Into the reaction vessel was introduced a mixture of silane gas, hydrogen gas and ethylene gas, and the mixture was then decomposed by glow discharge to form an about 0.25-μm surface layer on the charge capturing layer. The surface layer thus formed exhibited a contact angle of 85°. The producing conditions were as follows:

Flow rate of 100% hydrogen gas: 180 cm$^3$/min
Flow rate of 100% ethylene gas: 30 cm$^3$/min
Inner pressure of reaction vessel: 0.5 Torr
Discharge power: 50 W
Discharge time: 40 min A copying procedure was effected in the same manner as in Example 4. The image thus obtained exhibited the same fixability as obtained by heat fixing. No toner remained on the surface of the photoreceptor. The transfer efficiency was 99.5%. Even after repeated copying procedure, no toner adhesion was observed.

The transfer efficiency is defined by the following formula:

$$\text{Transfer efficiency (\%)} = \frac{\text{Amount of toner transferred to paper (g)}}{\text{Amount of toner developed to photoreceptor (g)}} \times 100$$

EXAMPLE 6

An experiment was effected in the same manner as in Example 5 except that the surface layer was replaced by a surface layer made of the following four kinds of materials. The transfer efficiency and the presence of toner adhesion were examined with the same toner as used in Example 3. The results are set forth in Table 3 along with the contact angle of the surface layer.

The producing conditions of the surface layer were as follows:

Surface Layer No. 1

Flow rate of 100% ethylene gas: 36 cm$^3$/min
Flow rate of 100% silane gas: 12 cm$^3$/min
Inner pressure of reaction vessel: 0.5 Torr
Discharge power: 500 W
Discharge time: 40 min
Thickness: 0.3 μm Surface Layer No. 2

Flow rate of 100% hydrogen gas: 180 cm$^3$/min
Flow rate of 100% ethylene gas: 36 cm$^3$/min
Flow rate of 100% silane gas: 24 cm$^3$/min
Inner pressure of reaction vessel: 0.5 Torr
Discharge power: 500 W
Discharge time: 40 min
Thickness: 0.4 μm Surface Layer No. 3

Flow rate of 100% hydrogen gas: 180 cm$^3$/min
Flow rate of 100% ethylene gas: 36 cm$^3$/min Flow rate of 100% silane gas: 36 $cm^3$/min
Inner pressure of reaction vessel: 0.5 Torr
Discharge power: 500 W
Discharge time: 40 min
Thickness: 0.5 μm Surface Layer No. 4

| | |
|---|---|
| Protective coating silicone (X-41-9710H, produced by The Shin-etsu Chemical Industry Co., Ltd.) | 50 parts by weight |
| Electrically conductive powder of tin oxide containing 15% of antimony oxide | 9 parts by weight |

These components were subjected to dispersion in admixture at a temperature of 10° C. for 50 hours. The dispersion was coated by a spray coating method, and then dried at a temperature of 180° C. for 1 hour to form a surface layer having a thickness of 1 μm.

TABLE 3

| Surface layer No. | Contact angle (degree) | Transfer efficiency (%) | Toner adhesion |
|---|---|---|---|
| 1 | 80 | 99.5 | None |
| 2 | 75 | 99.0 | None |
| 3 | 60 | 90.0 | None |
| 4 | 90 | 99.5 | None |

In accordance with the present invention, development is effected with a capsule toner on an amorphous silicon photoreceptor, and transfer and fixing are effected at the same time under pressure, making it possible to obtain a high quality image with an excellent fixability at a high reliability and a low cost in a simple process. If the contact angle of the surface layer is 60° or more, the resulting transfer efficiency is particularly excellent, causing no toner adhesion to the photoreceptor.

While the invention has been described in detail and with reference to specific embodiments thereof, it will be apparent to one skilled in the art that various changes and modifications can be made therein without departing from the spirit and scope thereof.

What is claimed is:

1. An electrophotographic process, which comprises the steps of: forming an electrostatic latent image on an amorphous silicon photoreceptor having a surface layer that exhibits a contact angle of 60° or more with pure water; developing said electrostatic latent image with a capsule toner; superimposing transfer paper on the capsule toner image thus formed; and simultaneously transferring and fixing said image on said paper by applying pressure.

2. An electrophotographic process as claimed in claim 1, wherein said amorphous silicon photoreceptor is heated while simultaneously transferring and fixing said image on said paper by applying pressure.

3. An electrophotographic process as claimed in claim 1, wherein said capsule toner is an electrically conductive magnetic one-component toner.

4. An electrophotographic process as claimed in claim 1, wherein said amorphous silicon photoreceptor comprises at least one of hydrogenated amorphous silicon and halogenated amorphous silicon.

5. An electrophotographic process as claimed in claim 1, wherein said surface layer comprises at least one of hydrogenated carbon and halogenated carbon.

6. An electrophotographic process as claimed in claim 1, wherein said surface layer comprises siloxane bonds.

7. An electrophotographic process as claimed in claim 1, wherein a pressure of from about 100 to 400 $kg/cm^2$ is applied to said paper.

8. An electrophotographic process as claimed in claim 7, wherein a pressure of from about 150 to about 350 $kg/cm^2$ is applied to said paper.

9. An electrophotographic process as claimed in claim 2, wherein said amorphous silicon photoreceptor is heated to a temperature of 30° to 80° C. while simultaneously transferring and fixing said image on said paper.

10. An electrophotographic process as claimed in claim 1, wherein said amorphous silicon photoreceptor comprises a support, a charge injection inhibiting layer formed over said support, a photoconductive layer formed over said charge injection inhibiting layer, and a surface layer formed over said photoconductive layer.

11. An electrophotographic process as claimed in claim 10, further comprising a charge capturing layer formed between said photoconductive layer and said surface layer.

12. An electrophotographic process as claimed in claim 11, further comprising at least one interlayer formed between said charge capturing layer and said surface layer.

* * * * *